US006453892B1

(12) United States Patent
Plunkett et al.

(10) Patent No.: US 6,453,892 B1
(45) Date of Patent: Sep. 24, 2002

(54) CONSTRAINED LAYER DAMPED STEEL BAFFLE

(75) Inventors: Tom Plunkett, Bolingbrook; Tom Staab, Chicago; Brent Boldt, Bartlett, all of IL (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/976,202

(22) Filed: Oct. 11, 2001

(51) Int. Cl.[7] ..... F02M 25/00
(52) U.S. Cl. ..... 123/572
(58) Field of Search ..... 123/572, 573, 123/574, 41.86

(56) References Cited

U.S. PATENT DOCUMENTS 4,223,073 A 9/1980 Caldwell et al.
4,678,707 A 7/1987 Shinozaki et al.
5,005,553 A * 4/1991 Washizu et al. ..... 123/572
5,323,740 A * 6/1994 Daily et al. ..... 123/41.86
5,474,840 A 12/1995 Landin
5,516,123 A 5/1996 Eckel
5,899,197 A * 5/1999 Watanabe et al. ..... 123/572
5,949,033 A 9/1999 Anagnos
6,194,803 B1 2/2001 Heim et al.
6,308,695 B1 * 10/2001 Watanabe et al. ..... 123/572

* cited by examiner

*Primary Examiner*—Marguerite McMahon
(74) *Attorney, Agent, or Firm*—Rader, Fishman & Grauer PLLC

(57) ABSTRACT

A damped steel baffle for an engine cam cover aids in separation of oil mist entrained in a flow of crankcase air vented through the cam cover, and directs the air to a PCV valve atop the cover. The baffle forms a channel for the air, and effectively absorbs noise generated within the cover. Oil droplets condense on channel and baffle surfaces, and drain to an engine oil sump. The interface between baffle and cam cover is sealed with a foam gasket layer or RTV sealant. The baffle is constructed of two metal layers joined together by a thin layer of viscoelastic adhesive that converts vibrational energy into heat to dampen resonant vibrations. Amplitudes of vibration are significantly lower than for plain steel baffles, hence lower sound radiation is achieved. The individual steel layers are 0.2 to 0.6 mm thick; the viscoelastic layer has a thickness up to 0.15 mm.

12 Claims, 2 Drawing Sheets

CONSTRAINED LAYER DAMPED STEEL BAFFLE

BACKGROUND OF THE INVENTION

1. Field of Invention

This invention relates generally to improvements in designs of baffles employed in automotive engine applications. More particularly, the invention relates to improvements in the manufacture of automotive engine cover applications, including valve covers, which are designed to reduce noise and vibration.

2. Description of the prior Art

Baffles for automotive engine valve covers have been traditionally formed of a single layer of thin stamped metal, such as steel. Such baffles are used generally not only to aid in the removal of oil mist entrained in crankcase gases, but are also designed to optimize crankcase air flow through the valve cover.

To the extent that the thin metal baffles have often been a source of noise, particularly as induced by engine vibrations, one recurrent theme with respect to such baffles has thus been the need for reducing such noise and for dampening vibrations. Several means of resolving the noise and vibration issues have been attempted; most typically have involved the use of foam coatings, others have made use of liquid gaskets (RTV). While many of the attempted efforts have been laudable, their benefits have often been costly and less than desirable in most cases.

The present inventors have felt that material improvements involving the actual physical structures of the baffles employed in automotive engine valve covers would undoubtedly produce longer lasting noise and vibration control benefits.

SUMMARY OF THE INVENTION

The present invention provides a constrained layer damped steel baffle for an engine cam cover. The baffle is designed to aid in the separation of oil mist entrained in a stream of crankcase air vented through the cam cover, and to direct the air to a positive crankcase ventilation (PCV) valve atop the cover. The baffle is also designed to block airborne noises generated within or otherwise resonating from within the cover. The baffle seals off a channel through which the air flows; oil droplets are enabled to condense on the channel walls or baffle and drain to an engine oil sump. The interface between the baffle and the cam cover may be sealed with a foam gasket or a liquid applied room temperature vulcanized (RTV) rubber based sealant.

As disclosed, the baffle is physically constructed of two metal layers joined together by a thin layer of viscoelastic adhesive. The adhesive converts vibrational energy into heat, and thus the baffle will be dampened from resonant engine vibrations. As such, peak amplitudes of vibration will be significantly lower than for single layer plain steel baffles; and lower amplitudes of vibration equate to lower sound radiation levels. As disclosed, the viscoelastic layer will have a thickness in a range of up to 0.15 mm. The individual steel layers will have thickness ranges of 0.2 to 0.6 m.

DETAILED DESCRIPTION OF THE EMBODIMENTS

Figure 1:
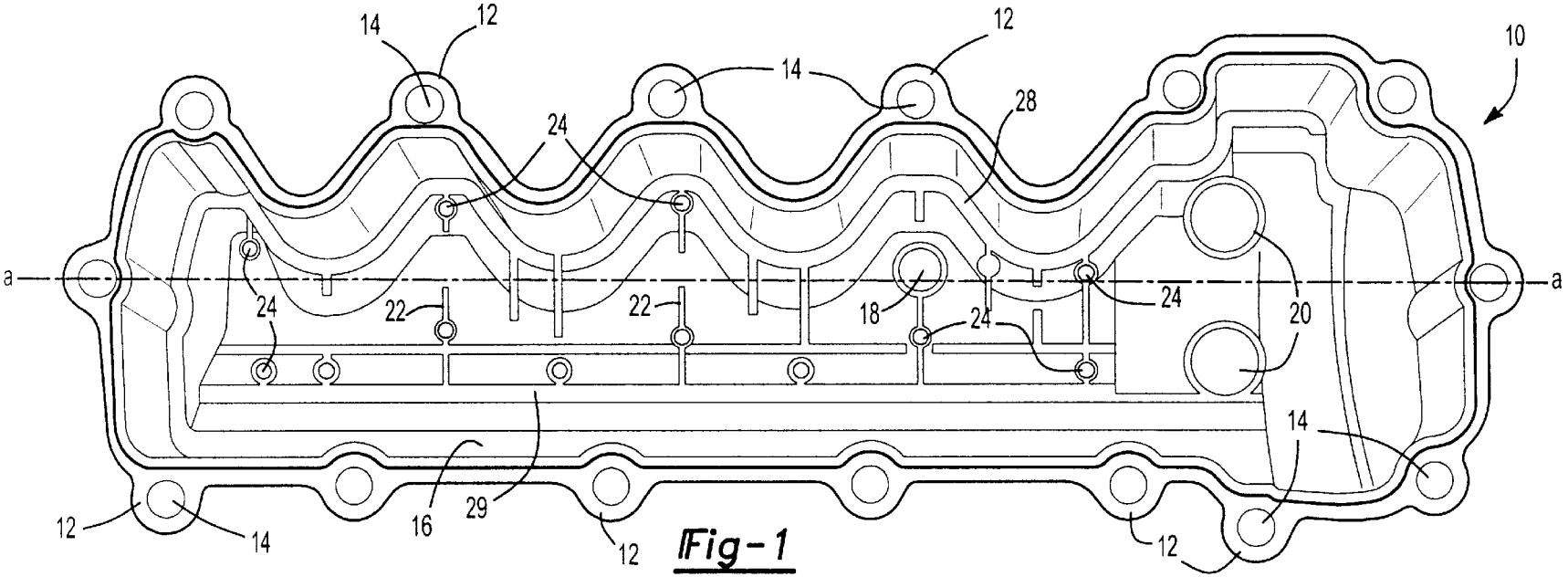
FIG. 1 is a plan view of the interior of a valve cover adapted to receive a constrained metal layer baffle constructed in accordance with one disclosed embodiment of the present invention.

Referring initially to FIG. 1, an automotive engine cam cover 10 is adapted to be securely attached to a cylinder head (not shown). Such cam covers have traditionally been made of stamped steel, but in recent years have also been made of molded plastic, cast aluminum, or cast magnesium materials. The cam cover 10 of FIG. 1 is formed of cast magnesium, and has a longitudinal dimension that extends along an axis a—a, as shown.

The cam cover 10 includes a plurality of bosses 12 for attachment of the cover 10 to a cylinder head (not shown). The bosses 12 include bolt apertures 14 for said attachment. The cam cover 10 includes an interior body portion 16 that includes a positive crankcase ventilation (PCV) aperture 18, as will be appreciated by those skilled in the art.

The cover 10 incorporates other apertures 20 as shown, for accommodation of hardware unrelated to this invention, such as electronic apparatus including cam phasers and the like. A plurality of laterally (i.e. arranged transversely to the axis a—a) extending ribs 22 are designed to create turbulence within a channel formed by, and situated between, a baffle 30 (FIG. 2) and the body portion 16 of the cover 10.

Figure 2:
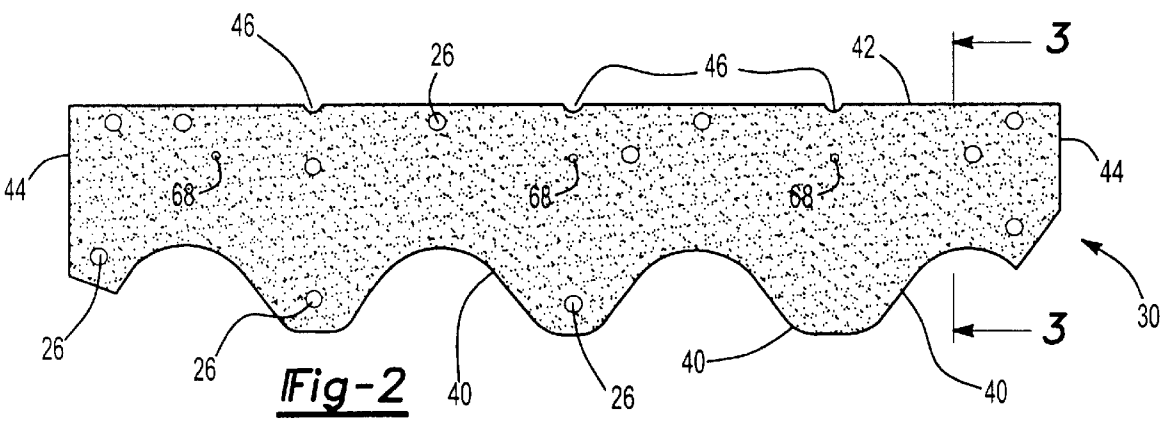
FIG. 2 is a plan view of one embodiment of a constrained metal layer baffle for use in the valve cover of FIG. 1.

Referring now also to FIG. 2, in the described embodiment the baffle 30 includes a plurality of attachment apertures 26, whereby the baffle 30 is adapted to be installed over and secured to a series of mating metal posts 24 integrally affixed to the interior body portion 16 of the cover 10. The posts 24 are adapted to be heat staked to secure the tops of the posts 24 down over and against the apertures 26, thus creating a mushroom-shaped head thereover. This invention is not, however, limited to such a securement format; i.e., rivets or screws can be used with similar success.

Figure 3:
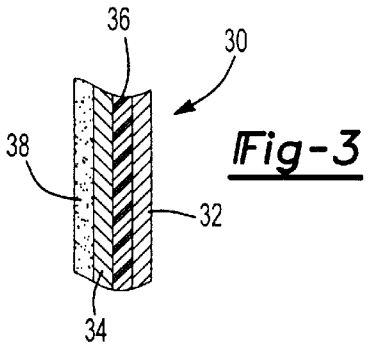
FIG. 3 is fragmentary cross-sectional side view of the constrained layer metal baffle, viewed along lines 3—3 of FIG. 2.

Referring now particularly to FIGS. 2 and 3, the baffle 30 is of the constrained metal layer type, and includes in the described embodiment at least four distinct layers. A primary or outer steel layer 32 is affixed to a secondary or inner steel layer 34 by means of a viscoelastic material layer 36. The viscoelastic layer 36 is interposed between the respective steel layers 32, 34. A sealant layer 38 is applied to the outer or exposed surface of the inner steel layer 34. The sealant layer can be formed of either a sealant foam or a liquid sealant room temperature vulcanized (RTV) rubber.

The sealant layer 38 is designed to make an effective seal along and against a longitudinal top edge 28 of the channel walls and baffle 30 and a bottom edge 29. In the described embodiment, the top edge 40 of the baffle is an undulating edge, while the bottom edge 42 is a relatively straight edge. For most effective sealing, the interior body portion 16 of the cover 10 incorporates a continuous undulating ridge 28 adapted to sealingly engage the top 40 of the baffle 30. Similarly, a relatively straight ridge 29 that extends along an axis a—a of the cover 10 is adapted to sealingly engage the bottom 42 of the baffle 30.

For assuring proper locating of the baffle 30, and to assure its proper position within the interior body portion 16 of the cover 10, a plurality of spaced notches 46 are adapted to interface with the lateral ribs 22 of the cover 10. By design, each notch corresponds to one associated rib. Those skilled in the art will appreciate that the lateral extremities 44 of the baffle 30 run transversely to the axis a—a, and are not sealed against the interior body portion 16. Thus, airflow from the crankcase travels rightwardly from one lateral extremity 44 to the other, between the baffle 30 and the interior body portion 16.

The lateral ribs 22 are adapted to create turbulence in the air channel defined as the space between the body portion 16 and the baffle 30. As a result of the turbulence, oil mist entrained in the crankcase airflow will tend to separate out of the airstream as droplets that condense on the baffle 30 and the channel walls (not shown). A series of oil drain holes 68 provide means by which the oil droplets may escape the baffle and channel regions and drain back into an oil sump.

Figure 4:
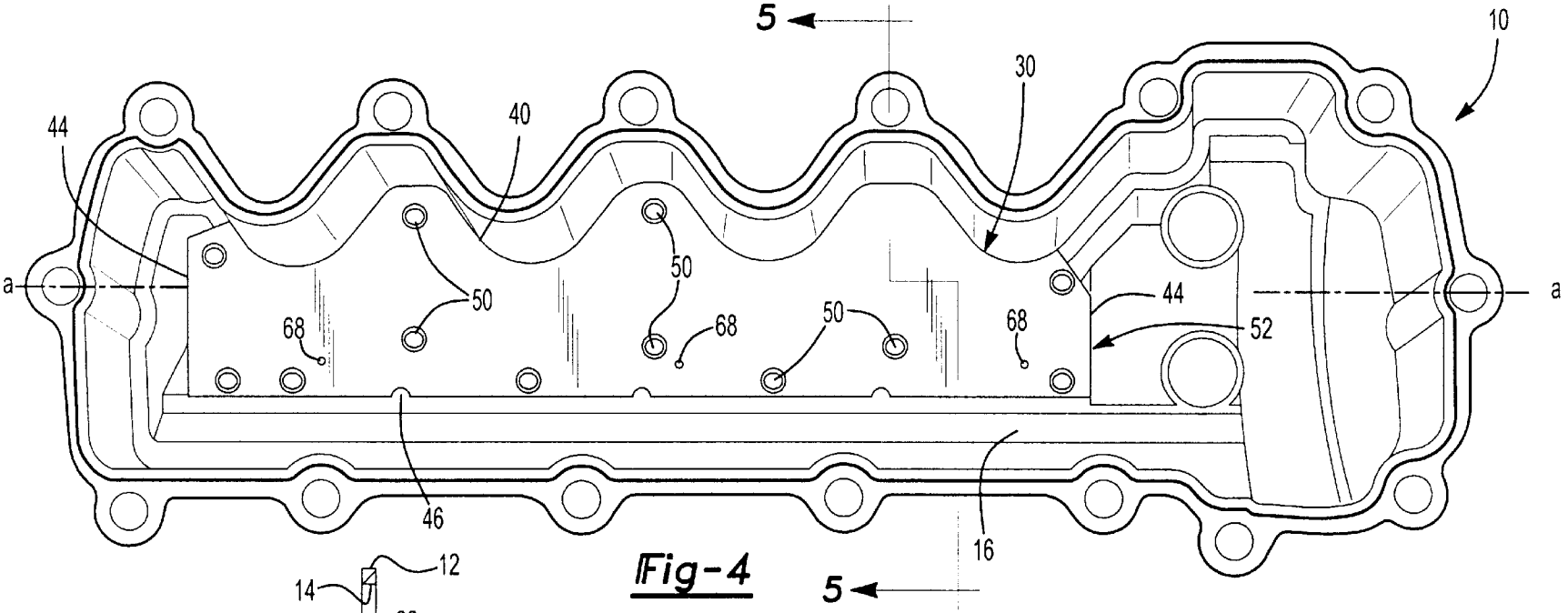
FIG. 4 is a plan view of the valve cover of FIG. 1, shown to include the baffle of FIG. 2.
Figure 5:
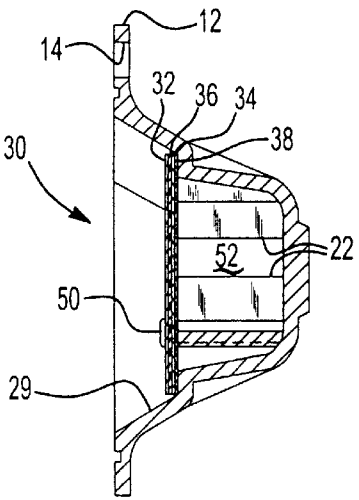
FIG. 5 is an end view of the cam cover and baffle, as viewed along lines 5—5 of FIG. 4.

Referring now to FIGS. 4 and 5, the baffle 30 is shown installed in place over the interior body portion 16 of the cam cover 10. These views depict the priordescribed airflow channel 52, as well as a series of mushroom-shaped heads 50, shown to have been heat staked into place over the apertures 26 (FIG. 1) of the baffle.

Referring back to FIG. 3, those skilled in the art will appreciate that the viscoelastic adhesive layer 36 is effective to convert vibrational energy into heat, and thus the baffle is adapted to dampen resonant vibrations, as previously noted. As was also noted, peak amplitudes of vibration will be significantly lower than those for single layer plain steel baffles of the prior art. The viscoelastic layer in the described embodiment has a thickness in a range of up to 0.15 mm. The individual steel layers have thickness ranges of 0.2 to 0.6 m.

Useful viscoelastic adhesives for providing the layer 36 may include, but are not limited to vulcanized or cross-linked elastomeric polymers. Such materials include natural rubber, isoprene rubber, butadiene rubber, styrene butadiene rubber, chloroprene rubber, butadiene acrylonitrile rubber, butyl rubber, ethylene propylene rubber (EPM, EPDM), acrylic rubber, halogenated butyl rubber, olefin-based rubber, urethane-based rubber (AU, EU), hydrin rubber (CO, ECO, GCO, EGCO), polysulfide-based rubber, silicone-based rubber, fluorine-based rubber (FKM, FZ), polyethylene chloride rubber, and blends of two or more of these elastomers.

The components or precursors of the viscoelastic adhesive layer 36 (e.g., base polymer and cross-linking agent) are blended together and then applied to the one or both of the steel layers 32, 34 using any conventional technique, such as roller coating, dipping, brushing, spraying, screen printing, and the like. Following application, the viscoelastic layer 36 is partially cured or B-staged so that it remains tacky. The two steel layers 32, 34 are then bonded together under heat and pressure (C-staged).

The precursors of the viscoelastic adhesive layer 36 may be cured or cross-linked using any known mechanism, including convection or radiation heating, or exposure to high-energy radiation, including electron beams or ultraviolet (UV) radiation. Useful UV curable adhesives typically comprise mixtures of multifunctional acrylate monomers and oligomers, photoinitiators, and surfactants. In addition to the base polymer or polymers and cross-linking agent, the viscoelastic adhesive layer 36 may include particulate fillers (e.g., carbon black, silica, etc.), antioxidants, plasticizers, curing co-agents, activators and catalysts, pot life extenders, and the like.

Finally, with respect to the sealant layer 38, if a foam sealant is used, the sealant will be preformed, and its thickness can be measured in either its compressed or uncompressed states. If measured in an uncompressed state, the foam thickness will be approximately 0.50 mm; in the compressed state, the foam thickness will be no more than 0.25 mm. On the other hand, if an RTV sealant is provided, and to the extent that the RTV coating is applied in a liquid form, a coating of approximately 0.1 mm is sufficient for an adequate seal.

It is to be understood that the above description is intended to be illustrative and not limiting. Many embodiments will be apparent to those skilled in the art upon reading the above description. The scope of the invention should be determined, however, not with reference to the above description, but with reference to the appended claims with the full scope of equivalents to which the claims are entitled.

What is claimed is:

1. A damped metal baffle adapted for mechanical securement to an interior body portion of an engine cam cover, said baffle adapted to separate oil mist entrained in engine crankcase air vented through the cam cover and to block airborne noise generated within the cover;

said baffle comprising at least two metal layers joined together by a layer of viscoelastic adhesive, wherein said baffle and the cam cover body portion together define an interface between them, and wherein the interface is sealed with a sealant material, whereby said baffle defines a channel through which the air flows between the baffle and said interior body, and wherein the sealant material seals the channel.

2. The damped metal baffle for a cam cover of claim 1 wherein said metal layers of said baffle are formed of steel, and said viscoelastic adhesive layer converts vibrational energy into heat, whereby said baffle dampens resonant vibrations.

3. The damped metal baffle for a cam cover of claim 1 wherein said viscoelastic layer comprises a thickness in the range of up to 0.15 mm., and said individual steel layers comprise thickness ranges of 0.2 to 0.6 m.

4. The damped metal baffle for a cam cover of claim 1, wherein said baffle comprises a plurality of spaced apertures adapted to permit oil droplets that condense within the channel and on said baffle to drain to an engine oil sump.

5. A damped steel baffle for a cam cover of claim 4, wherein said baffle comprises two laterally extending edge portions, one of said edge portions being undulating, the other being relatively straight.

6. The damped steel baffle for a cam cover of claim 5, wherein said baffle further comprises notches in said straight edge portion, said notches comprising apparatus for locating said baffle within the interior body portion of the cam cover.

7. The damped steel baffle for a cam cover of claim 6, wherein said baffle further comprises a plurality of apertures adapted for connection of said baffle to the interior body portion of the cam cover.

8. The damped steel baffle for a cam cover of claim 7, wherein said liquid sealant comprises an RTV sealant.

9. The damped steel baffle for a cam cover of claim 8, wherein said RTV sealant is adapted to make sealing contact between said baffle and the interior body portion of the cam cover along said laterally extending edge portions of said baffle.

10. The damped steel baffle for a cam cover of claim 9, wherein said RTV sealant is applied to said baffle with a thickness in the range of 0.1 mm.

11. The damped steel baffle for a cover of claim 7, wherein said sealant material comprises a foam sealant.

12. The damped steel baffle for a cam cover of claim 11, wherein said foam sealant is preformed.

* * * * *